United States Patent [19]

Brown, Jr.

[11] Patent Number: 5,004,226

[45] **Date of Patent: * Apr. 2, 1991**

[54] APPARATUS FOR EXERCISE OF THE HUMAN BODY

[75] Inventor: Gordon L. Brown, Jr., Bristol, Tenn.

[73] Assignee: Morrison Molded Fiber Glass Company, Bristol, Va.

[ * ] Notice: The portion of the term of this patent subsequent to Sep. 5, 2006 has been disclaimed.

[21] Appl. No.: 371,143

[22] Filed: Jun. 26, 1989

Related U.S. Application Data

[63] Continuation-in-part of Ser. No. 172,927, Mar. 25, 1988, Pat. No. 4,863,159.

[51] Int. Cl.[5] ..... A63B 21/02

[52] U.S. Cl. ..... 272/93; 272/902; 272/135; 272/137

[58] Field of Search ..... 272/93, 104, 125, 110, 272/137, 74, 75, 124, 143, 67, 68, 101, 134, 902, 116; 273/80 B, DIG. 7; 128/25 R

[56] References Cited

U.S. PATENT DOCUMENTS

| | | | |
|---|---|---|---|
| 234,309 | 2/1975 | Buchner | D34/5 K |
| 241,150 | 8/1976 | Hale | D34/5 K |
| 248,114 | 6/1978 | Mangiapane | D34/5 K |
| 263,327 | 3/1982 | Cooper | D21/191 |
| 264,738 | 6/1982 | Cooper | D21/198 |
| 267,261 | 12/1982 | Pataluch | D21/198 |
| 270,263 | 8/1983 | Kolbel | D21/198 |
| 274,539 | 7/1984 | Bankier | D21/191-99 |
| 281,446 | 11/1985 | Keilman | D21/191 |
| 289,538 | 4/1987 | Wilson | D21/198 |
| 3,246,893 | 4/1966 | Boggild et al. | 272/110 |
| 3,991,510 | 11/1976 | Bytheway | 272/93 |
| 4,428,577 | 1/1984 | Weingardt | 272/137 |
| 4,718,666 | 1/1988 | O'Donnell et al. | 272/137 |
| 4,725,057 | 2/1988 | Shifferan | 272/134 |
| 4,863,159 | 9/1989 | Brown, Jr. | 272/135 |

*Primary Examiner*—Stephen R. Crow

[57] ABSTRACT

An apparatus is disclosed for use in the exercise of the human body, which comprises a fiberglass pultruded shape of a predetermined oblong geometry with an elastic sheath formed about the exterior thereof over the length of the fiberglass pultruded shape. The fiberglass pultruded shape has fiberglass filaments dimensionally stabilized in a hardened resin system. Material properties of the filaments in the resin system are selected such that the ultimate elongation design value of the filaments and the resin system is greater than the actual maximum elongation of the filaments and the resin system when the fiberglass member is flexed in the exercise process. Also, the resin is selected for toughness sufficient to provide a useful flexural fatigue life.

5 Claims, 2 Drawing Sheets

FIG.1
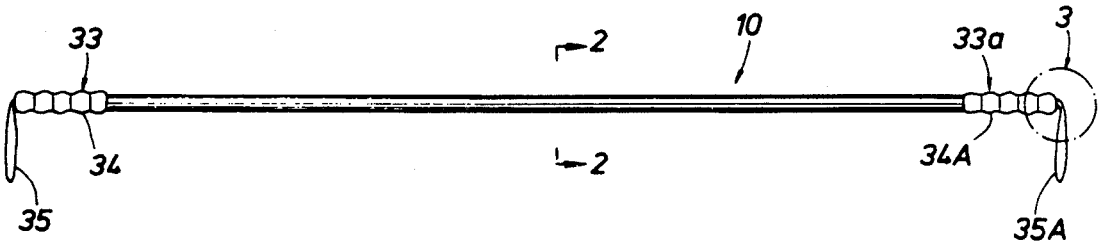
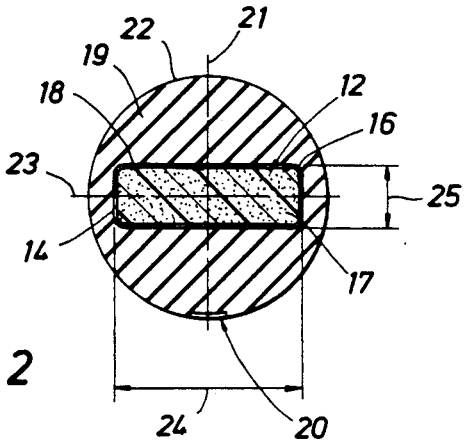
FIG. 2
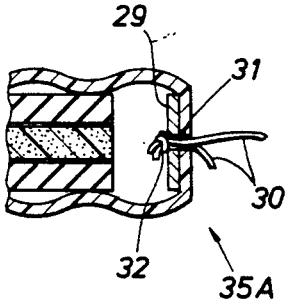
FIG. 3
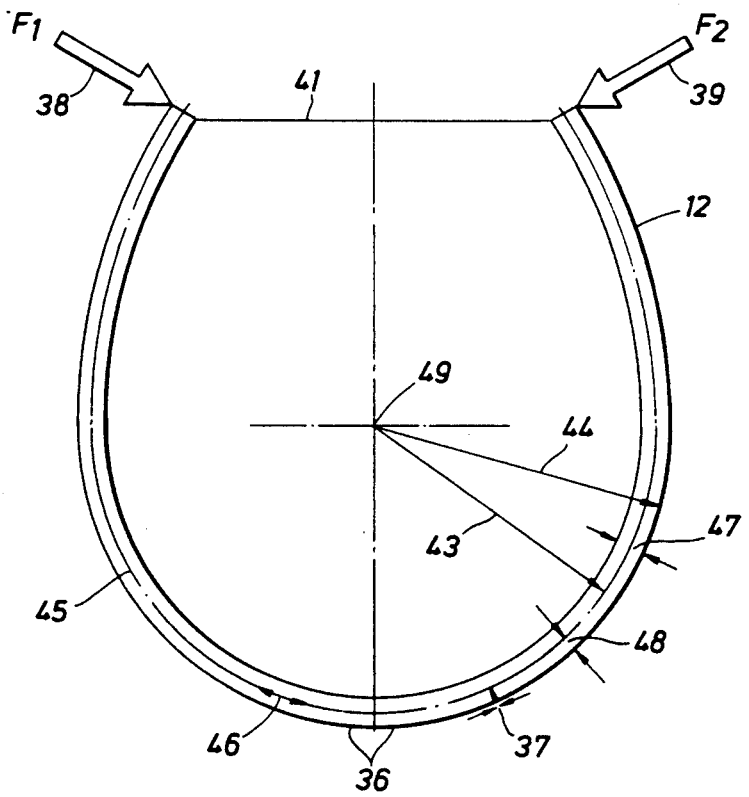
FIG. 4

APPARATUS FOR EXERCISE OF THE HUMAN BODY

RELATED APPLICATION

This application is a continuation-in-part of application Ser. No. 172,927, Filed Mar. 25, 1988, entitled Apparatus for Use in the Exercise of the Human Body, Gordon L. Brown, Jr. inventor, issued Sept. 5, 1989 as U.S. Pat. No. 4,863,159.

BACKGROUND OF THE INVENTION

Apparatus previously designed for the exercise of the human body will typically resist the force applied by the exerciser in a linear manner. Note for example bar bell weight sets, or exercise equipment which incorporates weights and pulleys wherein the exerciser pulls on a rope and thereby slides a weight system upwardly and downwardly on a vertical rail. In these systems the resistance applied to the exerciser is constant regardless of the position of the exercise equipment relative to the exerciser's body.

In the last several years optimum exercise results have been obtained by the use of variable resistance exercise equipment. Such equipment applies a variable non-linear resistance to the exerciser during the motion associated with an exercise movement. Note for example Nautilus equipment that incorporates a variable radius cam located between the exerciser and the weights. Rotation of such a cam requires the application of increasing force through portions of the cam's rotation.

Most variable resistance exercise equipment is not easily transportable, however, due to its weight and complexity, and therefore does not satisfy the need of the general population for an easily transportable exercise apparatus. It would be improbable for example, for a person leaving on a business trip to easily transport an entire Nautilus equipment assembly.

A lightweight, and therefore apparently portable variable resistance exercise apparatus therefore needs to be developed. The design and development of such an apparatus should incorporate any available new technology. Due to the close proximity of such an apparatus to the human body, such an apparatus should be safe to operate. Such an apparatus should also be easily manufacturable, lend itself to mass production, and have an acceptable longevity before failure.

In particular the longevity of the apparatus should allow enough cycles before failure to satisfy the purchaser's expectations for a piece of equipment that will last at least half a year or so. It can be easily calculated that such an exercise apparatus will be subjected to approximately 18,000 to 20,000 cycles during a six-month period of normal use. The cycles will vary in the strain imposed on the rod depending on the particular exercise being performed. The most severe strain is imposed when the rod is bent in a tear drop shape such that it's ends touch. Special consideration therefore need be directed to the selection of the material properties of such an exercise apparatus.

In related application Ser. No. 030,397, the exercise apparatus comprised a flexible fiberglass rod formed from a mixture of a tough, hardenable resin system and essentially longitudinal fiberglass filaments. Gripping the rod at both ends and thereafter attempting to bend the rod until both ends touched one another required the application of increasing force. The variable resistance feature of the rod is caused by the increase in the strain imposed on the fiberglass filaments located on the outer periphery of the rod, as the radius of curvature of the rod is decreased.

To evaluate the possibility of meeting the fatigue life requirement of 18,000 cycles, rods of ¼" diameter and ⅜" diameter were tested. A goal was to achieve about 10,000 cycles without failure where each cycle would see the rod bent to a tear drop shape with the ends touching. If this could be done then the consumer would be able to expect about 18,000 to 20,000 cycles where the strain of each cycle would vary from very small to the maximum which results when the ends of the rod are touched together. Various types of resins and fibers were used to fabricate the rods. The test results are given as follows:

| Resin/Fiber Type | Cycles to Failure |
|---|---|
| ¼ Inch Diameter 5-Foot Long Rod | |
| Dow 411/E-glass | 507 |
| *IP8520/E-glass | 1204 |
| Ryton ® PPS/E-glass | 2014 |
| 9310/S2-glass | 6832 |
| IP8520/PET fiber | 60000 |
| ⅜ Inch Diameter 5-Foot Long Rod | |
| *Dow 8084/E-glass | 7 |
| Dow 411/E-glass | 8 |
| Shell 828 + 871/E-glass | 700 |

*12% elongation resin

It is clear from the test results that the flexural fatigue performance of the circular cross section rods (both the ¼ and ⅜-inch diameter rods) was substantially below the acceptable life of the exercise rods. In view of the fact that even the ¼-inch diameter rods did not meet the fatigue life requirement, the plausibility of using fiber reinforced pultruded rods for exercise rods was, therefore, in doubt. Efforts were made to improve the fatigue life of the rods by using different types of resins including flexible high elongation resins. However, it is obvious from the test results that resin modification by itself would not be able to substantially improve the fatigue life of the rods to satisfy the 10,000 cycles life requirement. The use of different types of high performance fibers could enhance the fatigue life of the rods as demonstrated by the test results of the S2-glass rods. However, the cost of high performance fibers could jeopardize the marketability of the product. Although rods reinforced with polyester fiber did meet the fatigue life requirement of the exercise rods, one must bear in mind that polyester fiber by itself does not provide the appropriate stiffness performance of the rods and after repeated cycling the rod took a permanent bend (in the shape of an arc of a circle).

The maximum bending stress induced in the exercise rod bent into the shape of a teardrop, (FIG. 4), is given in Frisch-Fay, R., "Flexible Bars," London, Butterworths, 1962, pp. 1-11 as follows:

$$\textit{Maximum Bending Stress} = 2.19 * \pi^2 * E * (0.78c)/(4 * L) \quad (1)$$

where

2L = rod length

E = longitudinal modulus of the rod

2c = height of the rod cross-section

The glass content of the exercise rods was about 73-75% by weight or approximately 55-57% by volume. Hence, the following properties can be assumed for the unidirectional composites in the exercise rods.

Rods with E-glass fiber

E=6.0 Msi $X_t$=1.40–1.55 ksi (ultimate tensile strength)

Rods with S2-glass fiber

E=7.15 Msi $X_t$=230–243 ksi (ultimate tensile strength)

In general, the values of E and the ultimate tensile strength X will vary slightly with different resin systems. However, due to the lack of experimental data for the composite systems studied, they were assumed for the test to be the same for all resin systems.

Using Eqn. (1), the maximum flexural fatigue stresses induced in the 5-foot long ¼-inch diameter E-glass and S2-glass rods are 105.4 ksi and 125.6 ksi, respectively. Although the values of the flexural fatigue stress for the E-glass and S2-glass rods are below the static tensile strength of the corresponding composites, they are too high to provide the required fatigue life of the exercise rods. To estimate the fatigue life of the rods at these fatigue stresses, it is necessary to have the fatigue curves of the various composites that were used in the exercise rods. In particular, it is more appropriate to have the fatigue curves of the composites made by the pultrusion process. It is obvious that such curves will not be readily available since it is expensive and time consuming to generate them. Hence, approximate relations between fatigue stresses and cycles to failure were used in this test for the E-glass and S2-composites, as set forth in Hahn, H. T., Hwang, D. G., and Chin, W. K., "Effects of Vacuum and Temperature on Mechanical Properties of S2-Glass/Epoxy," Recent Advances in Composites in the United States and Japan, edited by Vinson/Taya, ASTM STP 864, pp. 600–618. For the E-glass composites, we have $$S_F X_t = 1.0 - 0.1 \cdot \log_{10}(N) \quad (2)$$

and for the S2-glass composites $$S_F/X_t = 1.115 - 0.154 \cdot \log_{10}(N) \quad (3)$$

where S is the fatigue stress and N is the number of cycles to failure. It is appropriate to point out that Eqns. (2) and (3) are not arbitrary, but are based on known experimental data on some equivalent composite systems. A comparison between the predicted fatigue life using Eqns. (2) and (3) and the test results obtained are given below for both the ¼ inch and the ⅜ inch diameter rods.

| Resin/Fiber Type | Actual Cycles to Failure | Predicted Cycles to Failure |
|---|---|---|
| ¼ Inch Diameter 5-Foot Long Rod | | |
| Dow 411/E-glass | 507 | 296–1585 |
| *IP8520/E-glass | 1204 | 296–1585 |
| Ryton ® PPS/E-glass | 2014 | 296–1585 |
| 9310/S2-glass | 6832 | 4946–7655 |
| IP8520/PET fiber | 60000 | — |
| ⅜ Inch Diameter 5-Foot Long Rod | | |
| *Dow 8084/E-glass | 7 | 1 |
| Dow 411/E-glass | 8 | 1 |
| Shell 828 + 871/E-glass | 700 | 1 |

*12% elongation resin

It can be seen from the comparison given above that reasonably good correlations can be obtained between the experimental results and the predicted life using Eqns. (1)–(3).

As can be seen, both the actual and predicted cycles to failure for both the ¼-inch and ⅜-inch diameter rod are unacceptably low. An exercise apparatus therefore need be designed that has a maximum flexural fatigue stress so as to insure an acceptable longevity, in the neighborhood of 18,000 cycles, to insure consumer acceptance of the durability of the apparatus, yet is stiff enough to provide a good workout for the exerciser.

SUMMARY OF THE INVENTION

After extensive analysis and by use of Equations 1–3, it was finally determined that the appropriate cross-sectional geometry of the exercise apparatus that would satisfy both the stiffness and life requirements is that of an oblong, the oblong having a major axis of a predetermined selected width and a minor axis of a predetermined selected height wherein the width of the cross-section in a preferred embodiment is from 2 to 7 times the height of the cross-section, (FIG. 2).

More specifically, the desired cross section geometries, as shown in FIG. 2, are given in Table 1 for oblong shapes constructed of S-2 glass fibers and an epoxy resin as follows:

TABLE 1

| Apparatus | Width (inches) | Length (inches) |
|---|---|---|
| Ladies' 5 feet | 0.5844 | 0.205 |
| Ladies' 4 feet, 6 inches | 0.64708 | 0.184 |
| Men's 5 feet, 8 inches | 0.74762 | 0.23 |
| Men's 5 feet | 0.81358 | 0.205 |
| Champion Model (5 feet, 8 inches) | 0.92600 | 0.23 |

Depending on the placement of the men's or ladies' hands on the apparatus, the force required to bend the men's apparatus until the ends touch would be approximately 24 to 30 lbs., and for a ladies' apparatus would be approximately 16 to 22 lbs. The men's champion apparatus would require 35 lbs. to flex the apparatus into the tear drop shape until the ends touch.

In general, if the spacing between the hand grips is shortened below that of the designed spacing, a larger force is required to bend the exercise apparatus into the teardrop shape and the corresponding fatigue life of the apparatus is reduced. For this reason the apparatus is designed with hand grips at both ends that encourage the placement of the exerciser's hands in the desired position at the ends of the apparatus.

The flexural fatigue life prediction at about 18,000 cycles of the exercise apparatus shown in Table 1 is based on the assumption that no reverse bending will occur in the service life. It is therefore a feature of the present invention to incorporate marker means such as stenciling or other marking well known to the art on the exercise apparatus to entice bending of the apparatus only in one direction.

Furthermore, to manufacture an exercise apparatus that is both safe and durable, the properties of the materials that form the pultruded shape having the oblong cross-section must be carefully selected. As described below, the filaments in the resin system that form the variable resistance portion of the exercise apparatus must have an ultimate elongation design value higher than the anticipated or actual measured elongation of the outer filaments of the exercise apparatus at its point of maximum flection.

The resin system used to dimensionally stabilize the filaments should have an ultimate elongation design value of from 2 to 8 times the anticipated or actual measured elongation of the outer filaments of the exercise apparatus at its point of maximum flection and have enough toughness to give acceptable flexural fatigue life. The filaments should have an ultimate elongation design value of a minimum of 1% to 2% above the anticipated or actual measured elongation of the outer filaments of the apparatus.

In the final apparatus design, the resin system may comprise Shell EPON® 9310 resin and S2 glass or Shell EPON® 828 resin and S2 glass.

It is therefore a feature of the present invention for an exercise apparatus to be constructed from a hardenable mixture of resin and essentially longitudinally oriented filaments having an ultimate elongation design value greater than the anticipated or actual measured elongation of the outer filaments of the apparatus at its point of maximum flection.

It is an object of the present invention to manufacture an easily transportable exercise apparatus having a variable resistance to forces applied to the ends of the apparatus that is a direct result of the type and percentage volume of fiber reinforcement.

It is another object of the present invention to fabricate an exercise apparatus that is safe, durable and will maintain straightness with only a slight amount of bow through its useful life.

These and other features, objects and advantages of the present invention will become apparent from the following Detailed Description, wherein reference is made to figures in the accompanying drawings.

IN THE DRAWINGS

FIG. 1 is a pictorial illustration of the exercise apparatus of the present invention, shown in its unflexed state.

FIG. 2 is a schematic representation of a cross-section taken along lines 2—2 of FIG. 1.

FIG. 3 is a schematic representation of a cross-section taken through the designated FIG. 3 area shown in FIG. 1.

FIG. 4 is a schematic representation showing the filament matrix means of the exercise apparatus in a flexed condition, the exterior extruded rubber sheathing and hand grips at each end not shown for the purposes of clarity.

DESCRIPTION OF THE PREFERRED EMBODIMENT

Figure 5:
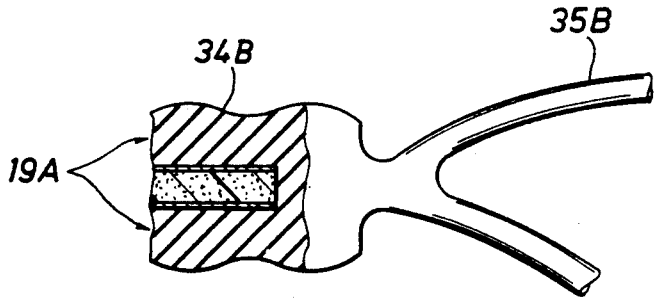
FIGS. 5–8 are schematic representations of alternative embodiments of the hand grip and hand retention means of FIG. 3.

Referring now to FIGS. 1–4, an exercise apparatus can be seen to comprise in a preferred embodiment filament matrix means 12 formed from a hardenable mixture of filaments 17 saturated with a resin system 18, the filament matrix means 12 having an oblong cross-section, more preferably a rectangular cross-section.

Apparatus 10 in an alternative embodiment may include surfacing veil 14, such as a NEXUS® veil Style No. 111-10 or 029 having a weight of 0.00768 lbs/sq ft, manufactured by Burlington Glass Fabrics Company, Link Drive, Rockleigh, N.J. 07647. The material of the veil 14 may be predominantly polyester, though it is well recognized that other materials such as nylon may also be used. The veil 14 may be formed during manufacture of the filament matrix means 12 about the outer periphery 16 thereof and would be chemically bonded thereto. The veil 14 would cover the filament matrix means 12 in order to contain any filaments 17 that may break away from the main body of the filament matrix means, and thereby protects the user of the apparatus 10.

The apparatus 10 further includes grip means 33, 33A operatively connected to each of the ends of the filament matrix means 12, comprising in a preferred embodiment hollow hand grips 34, 34A that are defined about each end of the exercise apparatus 10 such as by being press fitted over the ends of the apparatus 10. The hand grips in the preferred embodiment include injection molded black thermoplastic rubber grips with a grip body for a ¾" bar manufactured by A.M.E. Manufacturing, 244 Mercury Circle, Pomona, Calif. 91768.

The apparatus can also be seen to include hand retention means 35, 35A operatively connected to each of said two ends of the filament matrix means. Such hand retention means 35, 35A in one embodiment would include cord 30 formed from 5/32 inch flat braid PARALINE® coreless nylon or polypropylene cord manufactured by Gladding Cordage Corporation, P. O. Box 164, South Ostelic, N.Y. 13155-0164. Such a cord would be approximately 21¾ inches long with both of the ends fed into opening 31 and thereafter tied in a knot 32 behind washer 29. Such hand retention means would protect adjacent personnel and property if the exercise apparatus 10 slips from the grasp of the exerciser, by limiting the unrestricted travel of the apparatus 10 away from the exerciser.

It should be well understood that many other types of hand retention means may be used to accomplish the same mechanical result of restraining motion of the apparatus if the exerciser's hand slips from the end of the apparatus.

The apparatus 10 can also be seen to include an outer protective sheath 19 in one embodiment comprising 80 durometer non-marking styrenebutadiene rubber formed about the outer periphery 16 of the filament matrix means. The outer protective sheath can be seen to further include marker means 20 located relative to one intersection of the minor axis 21 with the outer sheath exterior 22. The marker means may be any suitable marking or imprinting label incorporated on the outer sheath exterior in order to encourage the user of the apparatus 10 to consistently bend the apparatus 10 in one direction. Avoiding reverse cycling or random bending in either direction of the apparatus 10 will insure that the cycles to failure of the apparatus is not significantly reduced. The marker means 20 may comprise the words, for example, "Bend in this direction".

The outer protective sheath is formed after manufacture of the filament matrix means about the outer periphery thereof, such as in one embodiment by feeding the filament matrix means through a thermoset rubber extruder or thermoplastic rubber extruder, available for example at Gates Molded Products Co., address FM 3898 Highway 290, P. O. Box 624, Brenham, Tex. 77833, or Vinylex Corp., 2636 Byington-Solway Road, Knoxville, Tenn. 37921, respectively.

It should be well recognized that the outer protective sheath 19 may be chemically bonded to the outer periphery 16 of the filament matrix means, by use of THIXON® OSN-2 solvent type coating manufactured by Whittaker Corp.-Dayton Division, 10 Electric Street, West Alexandria, Ohio 45382.

As seen in FIG. 2 the cross-sectional shape of the filament matrix means may be defined by a major axis 23 having a width 24 measured thereupon. The final width(s) 24, and height(s) 25 of the minor axis 21, to be used during manufacture of the apparatus 10 have been given in Table 1 above. In a preferred embodiment the outer protective sheath has a minimum spacing of 0.075 inches away from the outer periphery 16 of the filament matrix means so as to insure safe encapsulment of the matrix means within the sheath. The sheath in a preferred embodiment has a circular cross-section so as to ease installation of hand grips 34, 34A, to maximize the thickness of the sheath 19 above the areas of the filament matrix means subjected to possible fiber delamination from the surface of the matrix means 12, and to increase user comfort. In this manner, a safe exercise apparatus 10 is manufactured.

From study of the width and the height dimensions given in Table 1 it can be seen that in a preferred embodiment the width of the cross-section will be from 2 to 7 times the height of the cross-section. A 1/16" radius may be included at the corners of the cross-section to ease manufacturing of the filament matrix means 12, though it should be well recognized that other oblong cross-sections may be used to achieve the same mechanical result.

Proper selection of the materials of manufacture of the filament matrix means begins with an analysis of the anticipated stresses, strains and resultant filament elongations that will be encountered by the apparatus during its use. Since the magnitude of the repetitive force applied to the two ends will be relatively well known, (10 to 50 lbs), the elongation of the filaments located adjacent the outer periphery may be calculated using well known stress and strain equations developed from curved beam design. Also, the elastic material used for the outer protective sheath 19 will give a degree of support to the fibers near the surface and relieve the stress somewhat thereby increasing the life of the filament matrix means 12.

The stress (S) at any point on the fibers of the apparatus may be determined, and by knowledge of the modulus of elasticity "E" of the filaments, the units strain "e" 37 may also be readily determined. Reference, for example, FIG. 4 wherein the repetitive forces applied to the filament matrix means are represented by arrows F1 38 and F2 39. These forces 38, 39 bend the filament matrix means into a curved teardrop shape such that the ends are separated by an end proximity distance 41.

The lower section of the curved filament matrix means can be seen to have a neutral axis 45, radius RNA 43, and an outer radius RO 44, (the neutral axis 45 defined along the length 46 of the filament matrix means), an overall thickness T1 47 and a thickness T2 48 defined from the neutral axis 45 to outer filaments 36 located on the outer periphery that are subjected to maximum elongation.

The unit strain (e) 37 can be obtained by dividing the quantity (RO-RNA) by the quantity (RNA), for example. Other equations available and understandable to those having ordinary skill in the art may be used to calculate the maximum stresses occurring at the outer filaments 36 of the filament matrix means 12.

As may be expected the neutral axis 45 becomes located closer to the origin 49 of radii 44, 43, as the curvature of the filament matrix means is increased, and the maximum stress and thereby the maximum filament elongation will occur at radius RO 44. The shift of the neutral axis 45 toward origin 49 as the curvature of the filament matrix means is increased results in a nonlinear increase in the stresses along radius RO, which results in the variable resistance feature of the exercise apparatus 10.

Once the anticipated or actual stresses, strains, and elongation of the filament matrix means at the outer filaments 36 have been determined by calculations or by actual measurement of a prototype apparatus, in a preferred embodiment filaments having particular material properties may be selected so as to have an ultimate elongation design value greater than the anticipated or actual measured elongation of the filaments 36 located at the positions of maximum stress. In a like manner in a preferred embodiment a resin system may also be selected having an ultimate elongation design value 2 to 8 times greater than the anticipated or actual measured elongation of the outer filaments 36 of the apparatus at its point of maximum flection.

It should be well understood that the resins system will typically include not only the resin and its associated hardening agent, stabilizers, accelerators, etc. as are well known to the art, but may also include fillers such as talc, etc.

Proper calculations or testing of a prototype apparatus should therefore result in the final design of a filament matrix means of a selected length and a selected geometric oblong cross-section having a particular thickness T1 47 and a length 46 defined along neutral axis 45.

At least a portion of the filaments within the filament matrix means should be oriented parallel to the neutral axis to give the degree of variable resistivity required. In a preferred embodiment, the filament matrix means is formed by use of the pultrusion process wherein essentially all of the continuous rovings incorporating the filament 17 are oriented parallel to the neutral axis 45.

A portion of the filaments should be dimensionally stabilized or fixed within the hardened resin system so as to be located adjacent the outer periphery of the filament matrix means where the maximum bending stresses and elongations occur.

The resin system will surround the filaments as is well known in the pultrusion process.

More specifically, tests conducted on a prototype exercise apparatus having a diameter of ⅜th inch, a length of 6', and a calculated elongation of approximately 1.6%, have determined that the filaments should have an ultimate elongation design value of from about 2% to about 6%, and the resin system should have an ultimate elongation design value of from about 4% to about 12% when used with the above-referenced filaments.

In general, therefore, the resin system should have an ultimate elongation design value of from about 2 to about 8 times the anticipated or actual elongation of the outer filaments of the apparatus at its point of maximum flection.

Since the majority of the strength of the apparatus will come from the filaments, in a preferred embodiment the filaments are present in the filament matrix means in amounts from about 35 volume % to about 70 volume % of the total volume of the filament matrix means. Decreasing the filament volume % below 35% results in an apparatus with fiber distribution that is difficult to control to make an acceptable apparatus.

Above 70% it is difficult to insure adequate resin coverage around all of the filaments.

The filaments 17 in one embodiment comprise continuous "S-2 glass" fiberglass fibers having a tensile modulus of elasticity at 72° F. of $12.6\times10^6$, and ultimate elongation design value of 5.4% before breakage.

Of course, it should be well recognized that the filament 17 may be selected from the group consisting of continuous E-glass fiberglass fibers, A-glass fiberglass fibers, polyester fibers, polypropylene fibers, acrylic fibers, modacrylic fibers, rayon fibers, acetate fibers, fluorocarbon fibers, nylon fibers and/or a combination blend of the above fibers. It should be noted that a portion of the total fibers must contain glass fiber filaments so as to maintain the straightness of the exercise apparatus. For example, an all polyester fiber filament matrix means will develop a permanent bend after repeated flexure.

The resin system 18 in a preferred embodiment includes a Shell Epoxy Resin 828 manufactured by Shell Chemical Company, Houston, Tex., having approximately 4 to 7% ultimate elongation design value before breakage.

Of course, it should be well recognized that the resin may also be selected from the group consisting of vinyl ester resins, thermoplastic resins and/or for example epoxy resins with an anhydride cure.

Once the filaments and resin systems have been selected, they may be combined such as by use of the pultrusion process or other processes that insure the fibers are all oriented at an angle of less than 3° from the longitudinal axis. As the filament matrix means is being formed by whatever process a surfacing veil 14 may be incorporated into the outer periphery thereof. The entire apparatus may then be assembled in a preferred embodiment by processing the filament matrix means through an extruder which places an elastic compound over the filament matrix means, and thereafter incorporating or separately attaching the hand grips 34 and hand retention means 35, 35A to each end.

It should be well understood that the outer protective sheath may be formed from any suitable elastomeric material such as a SBR Thermoset Rubber, EPDM Thermoset Rubber, Thermoplastic Rubber (such as "SANTOPRENE" manufactured by Monsanto), PVC Thermoplastic, or Nylon Thermoplastic.

It should be well recognized that the hand grips 34,34A in an alternative embodiment, as well as the hand retention means 35,35A, may take several different forms. Referring to FIG. 5, the hand grip(s) 34B may be formed common with the outer protective sheath 19A by simultaneous injection molding of the grip(s) 34B and sheath 19A. Such injection molding may be performed, for example, by Plastics Services Companies, 1800 Macleod Drive, Lawrenceville, Ga. 30243.

Figure 7:
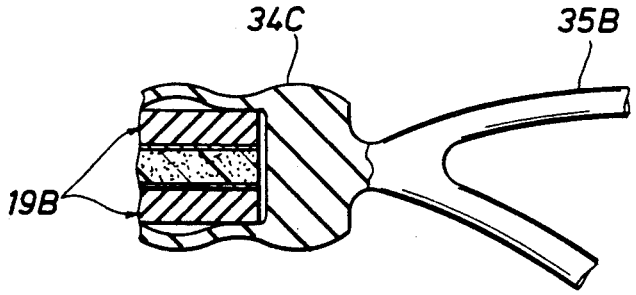

Additionally, the hand retention means 35B may be formed common with each of the hand grips 34B by including appropriately shaped runners in the mold used to form the grips. The hand retention means 35B may be commonly molded with hand grip(s) 34C (FIG. 7) that are press fitted over the protective sheath 19B.

Figure 6:
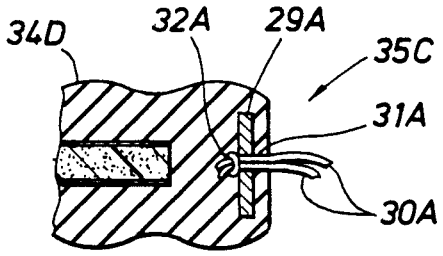

In an alternative embodiment the hand retention means 35C (FIG. 6) includes a washer 29A having an opening 31A defined therethrough, and a looped cord 30A passed through the opening and knotted at both ends by knot 32A adjacent the opening 31A. The washer and knotted ends are encased during injection molding of the hand grip 34D (FIG. 6) that is formed common with the outer protective sheath 19A (FIG. 5).

Figure 8:
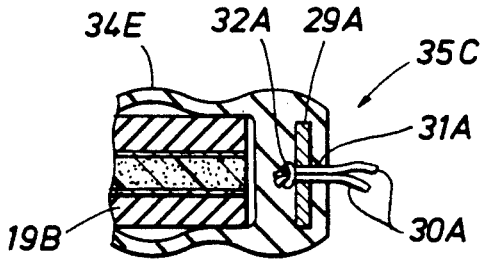

In another alternative embodiment the hand retention means 35C (FIG. 8) includes a washer 29A having an opening 31A defined therethrough, and a looped cord 30A passed through the opening and knotted at both ends by knot 32A adjacent the opening 31A. The washer and knotted ends are encased during injection molding of the hand grips (2) 34E over the outer protective sheath 19B.

It should be well recognized that to ease transportation of this exercise apparatus, the apparatus may be fabricated in short two foot long sections that may be connected at each end in order to form an apparatus 10 having sufficient length and flexibility. Such end connections may be formed by correct molding of the filament matrix means, for example, into a pin and socket connection where the ends may connect to threaded connections well known to the art, or any other means may be used to connect one segment of the exercise apparatus to another adjacent section.

Many other variations and modifications may be made in the apparatus and techniques hereinbefore described by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

I claim as my invention:

1. An apparatus for use in the exercise of the human body, said apparatus comprising:

filament matrix means of a selected length having a neutral axis defined therethrough, said filament matrix means having an oblong cross-section with a major axis of a selected width and a minor axis of a selected height defined therethrough, wherein the width of the cross-section is from 2–7 times the height, said filament matrix means having;

two ends, filaments, a portion of said filaments being oriented at an angle of less than 3 degrees from said neutral axis, a portion of said filaments containing glass fibers, said filaments constituting from about 35 volume percent to about 70 volume percent of said filament matrix means and having an ultimate elongation design value from about 2 percent to about 6 percent, and a resin system constituting from about 30 volume percent to about 65 volume percent of said filament matrix means, and having an ultimate elongation design value from about 4 percent to about 12 percent, wherein the length and cross-section of said filament matrix means, and percentage of the volume of said filaments and said resin system included within said filament matrix means, and the ultimate elongation design value of said filaments and said resin system, are selected such that the maximum elongation in said filaments and said resin system, when the distance separating the ends of the filament matrix means is minimized by the application of force to said two ends, is less than the ultimate elongation design value of said filaments and said resin system, an outer protective sheath formed from an elastomeric material attached to said filament matrix means along the length thereof and having an outer circular cross-section and two ends terminating proximate said ends of said filament matrix means, two hand grips, one hand grip defined about each end of said outer protective sheath and positioned parallel to said neutral axis, and hand retention means operatively connected to one end of each of said hand grips, said hand retention means sized to allow the passage of a hand therethrough.

2. The apparatus of claim 1 wherein said two hand grips are formed separate from said outer protective sheath, each hand grip being press-fitted over one end of said outer protective sheath.

3. The apparatus of claim 1 wherein said two hand grips are formed common with said outer protective sheath about said filament matrix means by simultaneous injection molding of said hand grips and said outer protective sheath.

4. The apparatus of claim 1 wherein said hand retention means of each end of said hand grips further comprises;

a washer having an opening defined therethrough, and a looped cord passed through said opening and knotted at both ends adjacent said opening, said washer and knotted ends encased within the material of said hand grip.

5. The apparatus of claim 1 wherein said hand retention means are formed common with each of said two hand grips by simultaneous injection molding of said hand grips and said hand retention means.

* * * * *